US005201864A

United States Patent [19]

Brackett

[11] Patent Number: 5,201,864

[45] Date of Patent: Apr. 13, 1993

[54] NEWSPRINT TRASH COMPACTOR

[76] Inventor: Ted Brackett, 102 Rosecrans Ave., Manhattan Beach, Calif. 90266

[21] Appl. No.: 878,088

[22] Filed: May 4, 1992

[51] Int. Cl.[5] ..... B65B 13/18

[52] U.S. Cl. ..... 100/34; 100/265; 211/50

[58] Field of Search ..... 100/1, 34, 242, 265; 211/50

[56] References Cited

U.S. PATENT DOCUMENTS

| | | | |
|---|---|---|---|
| 838,392 | 12/1906 | Dulin . | |
| 968,793 | 8/1910 | Parr | 100/242 X |
| 1,246,923 | 11/1917 | Horrigan | 100/34 X |
| 1,352,345 | 9/1920 | Becker . | |
| 2,653,431 | 9/1953 | Robinson . | |
| 3,455,234 | 7/1969 | Foulke . | |
| 3,604,182 | 9/1971 | Jepsen . | |
| 3,826,186 | 7/1974 | Mechler | 100/34 X |
| 4,006,576 | 2/1977 | Tetenborg . | |
| 4,934,262 | 6/1990 | Turi et al. | 100/34 |

*Primary Examiner*—Harvey C. Hornsby
*Assistant Examiner*—Stephen F. Gerrity

[57] ABSTRACT

The improved newsprint trash compactor uses an open-topped container, at least two opposite inner sides of which are lined with bristle brushes or rough surfaced elastomeric blocks, to releasably hold newsprint in place while it is being hand shoved against a spring loaded floating platform in the bottom of the container. The holders have opposed vertical grooves which run the height of the holders and which receive a strip of baling tape which is also trained over the platform. The tape is used to bundle the compacted newsprint and lift it out of the container. The compactor is simple, durable, inexpensive and easy to use. It can serve as a household trash container as well as trash compactor.

8 Claims, 2 Drawing Sheets

NEWSPRINT TRASH COMPACTOR

BACKGROUND OF THE INVENTION

1. Field of the Invention

The present invention generally relates to trash handling means and more particularly to an improved trash compactor for newsprint and the like.

2. Prior Art

Complicated devices are used to crush cans to save space. Electrically powered expensive press compactors have also been used at home, in offices, etc., to compact other types of trash, as well as cans. However, heretofore little has been done to provide small economical compactors for the large volumes of newsprint deluging private homes and businesses daily. These include newspapers, magazines, junk mail, hand circulated fliers, etc. Such newsprint trash quickly accumulates and constitutes a fire hazard. It is very difficult to bundle up, handle, transport, and dispose of for cash at recycling plants and the like.

SUMMARY OF THE INVENTION

The improved newsprint trash compactor satisfies all the foregoing needs. The compactor includes an open-topped, preferably rectangular housing or container, defining a central space in the bottom of which is mounted a floating platform supported on springs. The interior surfaces of at least two opposite sides of the container are lined with resilient, flexible, rough surfaced newspaper holders comprising bristle brushes or blocks of elastomeric rubber or plastic. The brushes or blocks have opposed vertical grooves in them from top to bottom, which grooves releasably hold a binding tape which also extends over the platform at the bottom of the space. A tape dispenser is connected to the exterior of the housing and a tape cutter may also be connected to the housing.

The tape can be dispensed down the space by the weight of the newsprint trash on top of it. Such trash includes newspapers, circulars, magazines, junk mail, hand out sheets, etc. When the trash has filled the container space, it can be compressed by hand against the spring platform and then the tape is looped over the top of the spaced, tied off and cut and then used as a handle to pull the resulting trash handle up and out of the container for disposal.

The compactor is simple, durable, inexpensive, and efficient to use. Further features of the invention are set forth in the following detailed description and accompanying drawings.

DRAWINGS

DETAILED DESCRIPTION

FIGS. 1 & 2

Figure 1:
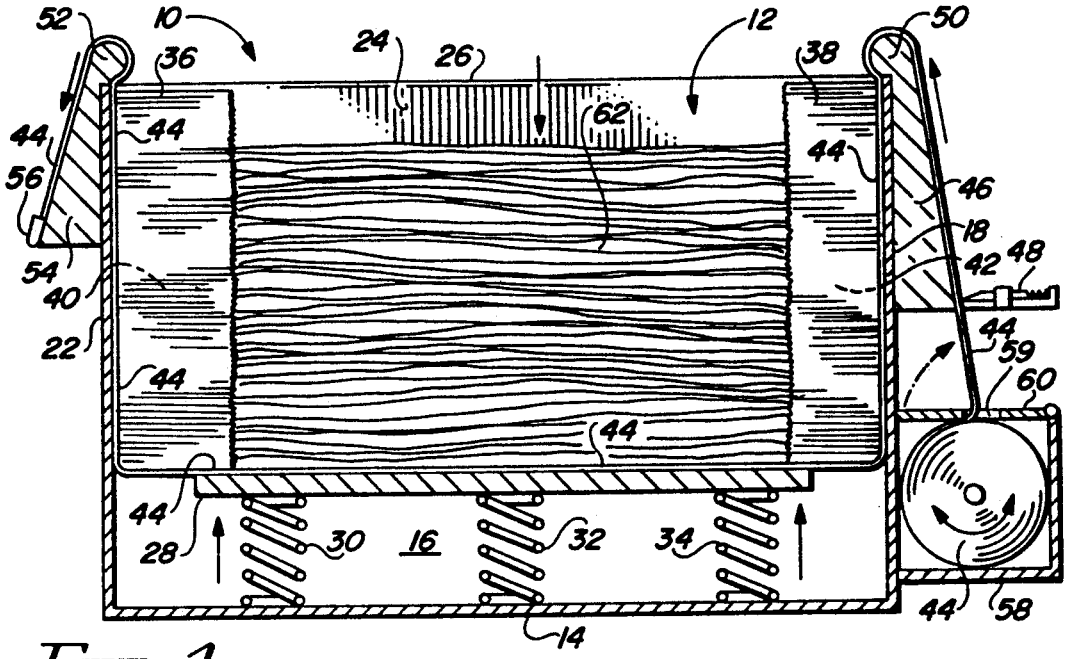
FIG. 1 is a schematic vertical cross-section at the middle of a first preferred embodiment of the improved newsprint trash compactor of the present invention.
Figure 2:
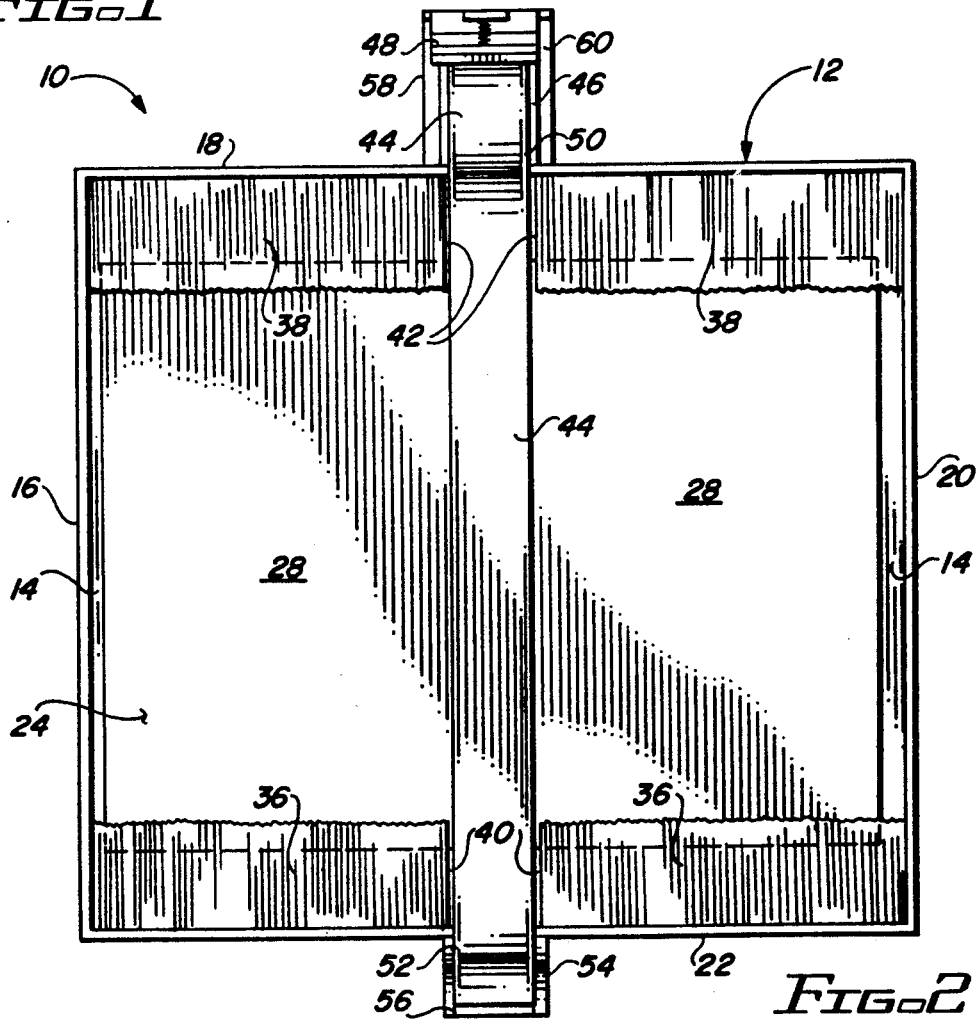
FIG. 2 is a schematic top plan view of the compactor of FIG. 1.

Now referring more particularly to FIGS. 1 & 2 of the drawings, a first preferred embodiment of the improved newsprint trash compactor of the present invention is schematically shown therein. The compactor can be just as easily used for other dry trash, as well as newsprint and should be understood as also covering such other kinds of trash.

Thus, compactor 10 is shown, which includes a preferably square or rectangular container 12 having a closed horizontal bottom 14 and upraised vertical sides 16, 18, 20 and 22 connected thereto, collectively defining a central space 24 and open top 26.

Mounted in the bottom portion of space 24 is a horizontal platform 28 supported by vertical coiled springs 30, 32 and 34 connected to bottom 14. A pair of brushes 36 and 38 with their bristles facing into space 24 are mounted on the inner surfaces of vertical sides 22 and 18, respectively, and extend from platform 28 to top **26*a*. A pair of opposed vertical slots or grooves 40 and 42 centered in brushes 36 and 38, and running the entire height thereof, respectively, receive and releasably hold an elongated strip of binding tape 44 which initially runs to a tape supply ramp 46 through a guillotine cutter 48 and then to guide 50 on the exterior surface of side 18 adjacent top 26, then down groove 42, then over platform 28 and up groove 40 and guide 52, then down ramp 54 to a spring holder clip 56. Ramp 54 is affixed to the exterior of side 22 adjacent top 26. Tape 44 can initially be fed up out of tape holder 58 from a roll thereof through a slot 59 in hinged lid 60 thereof to ramp 46, as needed. Holder 58 is connected to the exterior of side 18 adjacent bottom 14**.

Trash 62 is first loaded into container 12 to a desired depth through top 26, pushing tape 44 below it against platform 28. Trash 62 is compacted by hand by pushing down against the spring resistance of platform 28, during and after which one end of tape 44 is unclipped from clip 56, joined with the other end of tape 44 after cutting it off the appropriate length of tape 44 in guillotine cutter 48, cinched around the top of trash 62 to form a bundle and tied together, after which the resulting bundle is lifted from container 12 out through top 26 by bound tape 44 and disposed of. A new length of tape 44 is then fed out of holder 58 through slot 59 in lid 60 to line container 12 to await reception of another load of newsprint of trash 62.

Compactor 10 can be made of metal, wood, plastic and other materials and combinations thereof, in any desired size Tape 44 can be conventional binding tape or the like. Compactor 10 is efficient, easy to use, durable and inexpensive.

FIG. 3.

Figure 3:
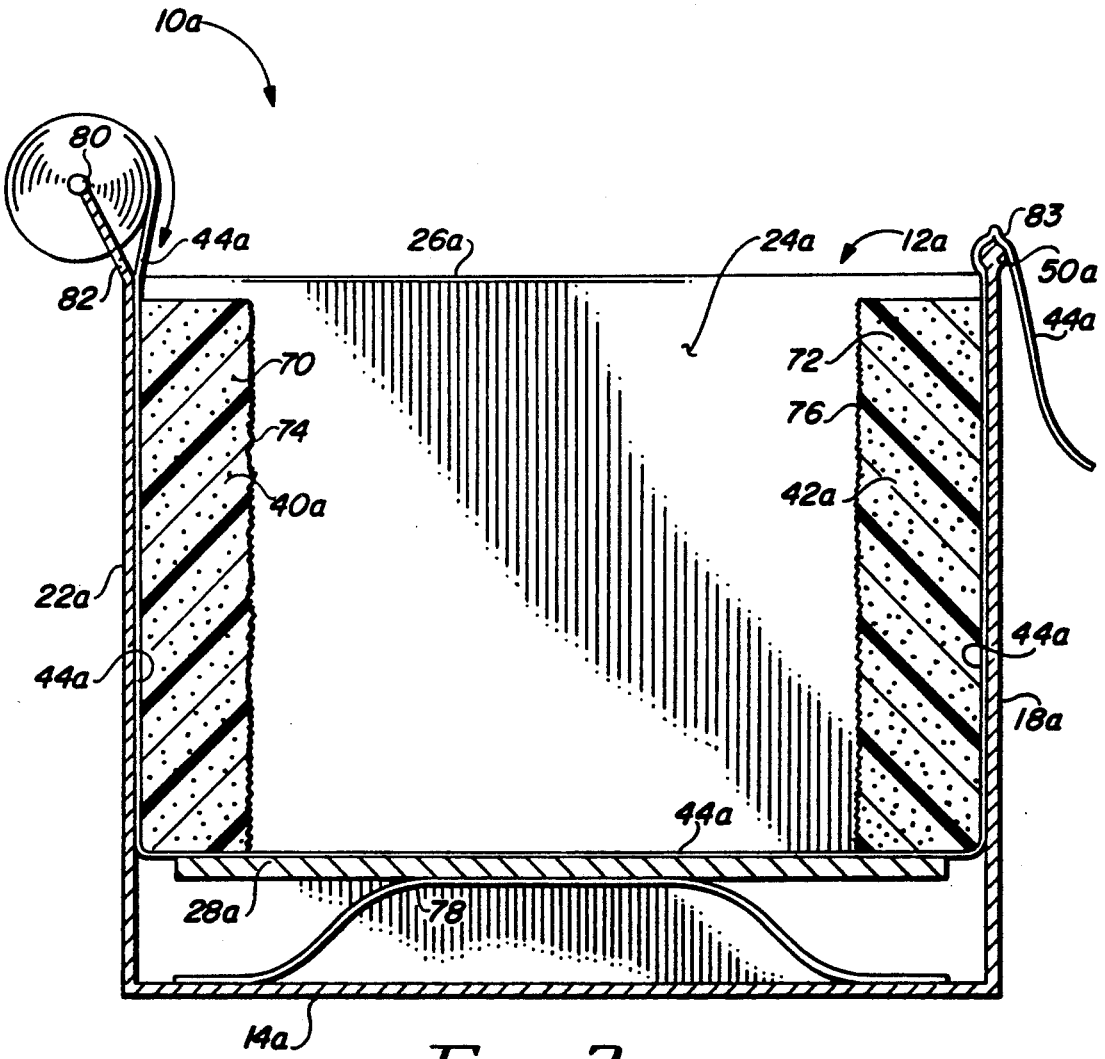
FIG. 3 is a schematic vertical cross-section of a second preferred embodiment of the improved newsprint trash compactor of the present invention.

A second preferred embodiment of the improved newsprint trash compactor of the present invention is schematically depicted in FIG. 3. Thus, compactor **10*a* is shown. Components thereof similar to those of compactor 10** bear the same numerals but are succeeded by the letter "a".

Compactor **10*a* is substantially identical to compactor 10**, except as follows:

a) Brushes 36 and 38 of compactor 10 are substituted for by blocks 70 & 72 of flexible, resilient elastomer, namely, natural or synthetic rubber or plastic, having rough or irregular surfaces 74 and 76, respectively, facing into space **24*a*, but otherwise similar to brushes 36 and 38**;

b) coiled springs 30, 32 and 34 are substituted for by a single leaf spring 78;

c) Tape **44*a* is disposed on a roller 80 on an arm 82 at the top of side 22*a* instead of in holder 58; and, d) Tape 44a runs over guide 50a which has a sharp edge 82 which acts as a cutter, eliminating cutter 48 and clip 56**.

It will be noted that tape 44a is fed in the reverse direction from tape 44 and that ramps 46 and 54 are eliminated. Collector 10a has the advantages of collector 10.

Various modifications, changes, alterations and additions can be made in the improved newsprint trash collector of the present invention, its components and parameters. All such changes, modifications, alterations and additions as are within the scope of the appended claims form part of the present invention.

What is claimed is:

1. An improved trash compactor for newsprint or the like, said compactor comprising, in combination:

a) a housing having an open top and a plurality of opposed closed substantially vertical sides and substantially a closed bottom defining a central space;

b) a platform in and adjacent the bottom of said central space;

c) spring means supporting and biasing said platform upwardly in said space;

d) opposed resilient, flexible newsprint holders lining the interior of at least two opposed sides of said housing above said platform, said opposed holders having opposed vertical grooves therein running the entire height thereof;

e) strapping and lifting tape extending into said space over said platform and in said opposed grooves for binding a bundle of newsprint held by said holders on said platform and for lifting said bundle out said top.

2. The improved newsprint trash compactor of claim 1 wherein said housing is one of generally square and rectangular.

3. The improved newsprint trash compactor of claim 1 wherein said holders comprise bristle brushes.

4. The improved newsprint trash compactor of claim 1 wherein said holders comprise resilient, flexible elastomeric blocks having irregular surfaces facing said central space.

5. The improved newsprint compactor of claim 4 wherein said elastomeric blocks comprise at least one of natural rubber, synthetic rubber and plastic.

6. The improved newsprint trash compactor of claim 1 wherein said spring means comprise at least one of coil springs and leaf springs.

7. The improved newsprint trash compactor of claim 1 wherein said housing includes a dispenser for said tape and a cutter for said tape.

8. The improved newsprint trash collector of claim 7 wherein said collector includes a tape retaining clip.

* * * * *